US007828226B2

(12) United States Patent
Martin

(10) Patent No.: US 7,828,226 B2
(45) Date of Patent: Nov. 9, 2010

(54) HANDHELD DEVICE AND METHOD FOR CLEARING OBSTRUCTIONS FROM SPRAY NOZZLES

(76) Inventor: Phillip John Martin, 2313 16th St., Great Bend, KS (US) 67530

( * ) Notice: Subject to any disclaimer, the term of this patent is extended or adjusted under 35 U.S.C. 154(b) by 332 days.

(21) Appl. No.: 12/042,008

(22) Filed: Mar. 4, 2008

(65) Prior Publication Data

US 2008/0265057 A1 Oct. 30, 2008

Related U.S. Application Data

(60) Provisional application No. 60/926,095, filed on Apr. 26, 2007.

(51) Int. Cl.

| | |
|---|---|
| ***A62C 5/02*** | (2006.01) |
| ***A62C 31/02*** | (2006.01) |
| ***B05B 1/28*** | (2006.01) |
| ***B05B 15/02*** | (2006.01) |
| ***B05B 7/02*** | (2006.01) |
| ***F23D 11/34*** | (2006.01) |

(52) U.S. Cl. ..... 239/8; 239/104; 239/106; 239/119; 239/390; 239/391; 239/525; 239/600

(58) Field of Classification Search ..... 239/1, 239/8, 104, 106, 110, 119, 288.3, 288.5, 239/390, 391, 392, 397, 436, 442, 443, 525, 239/526, 589, 596, 600

See application file for complete search history.

(56) References Cited

U.S. PATENT DOCUMENTS

| | | | | |
|---|---|---|---|---|
| 700,009 | A | | 5/1902 | Bean |
| 2,564,431 | A | | 8/1951 | Greenspoon et al. |
| 3,047,986 | A | | 8/1962 | McKulla et al. |
| 3,284,007 | A | | 11/1966 | Clapp |
| 3,851,352 | A | | 12/1974 | Hibberd et al. |
| 4,147,152 | A | | 4/1979 | Fischer et al. |
| 4,833,171 | A | | 5/1989 | Sweeney |
| 4,977,911 | A | | 12/1990 | Vetter et al. |
| 4,982,900 | A | | 1/1991 | Blake |
| 5,052,624 | A | * | 10/1991 | Boers et al. ..... 239/525 |
| 5,183,066 | A | | 2/1993 | Hethcoat |
| 5,255,848 | A | | 10/1993 | Rhodehouse |
| 5,379,939 | A | | 1/1995 | Perret, Jr. |
| 5,609,302 | A | * | 3/1997 | Smith ..... 239/526 |
| 5,634,456 | A | | 6/1997 | Perrone |

(Continued)

*Primary Examiner*—Len Tran
*Assistant Examiner*—Ryan Reis
(74) *Attorney, Agent, or Firm*—Kenneth H. Jack; Davis & Jack, LLC

(57) ABSTRACT

A handheld device and method for clearing obstructions from spray nozzles includes a housing, a gas valve system contained within the housing, and a nozzle body attachment structure. A trigger associated with the gas valve system is operable to release a blast of compressed gas through the attachment structure. A spray nozzle placed in contact with the attachment structure receives a blast of compressed gas to clear obstructions. The attachment structure interfaces with both the normal discharge side and the normal inlet side of the spray nozzle to allow compressed gas to be blown through the spray nozzle in both directions. A backup tool is provided to engage a backside of the spray nozzle to prevent a spray tip within the spray nozzle from blowing backwards out of the spray nozzle. A backup tool cover has a slender projection for removing screen filters associated with the spray nozzle.

19 Claims, 5 Drawing Sheets

U.S. PATENT DOCUMENTS 5,676,184 A 10/1997 Houser
5,704,548 A * 1/1998 Hedger et al. ..... 239/119
5,832,974 A * 11/1998 Jou ..... 141/392
5,853,128 A 12/1998 Bowen et al.
6,126,087 A 10/2000 Hedger et al.
6,142,387 A * 11/2000 Jou ..... 239/390
6,418,944 B1 7/2002 White et al.
6,505,784 B1 * 1/2003 Jou ..... 239/525
6,854,663 B2 2/2005 Bugarin
6,918,546 B2 7/2005 Leisi
2005/0035220 A1 * 2/2005 Brown ..... 239/432

* cited by examiner

HANDHELD DEVICE AND METHOD FOR CLEARING OBSTRUCTIONS FROM SPRAY NOZZLES

RELATED APPLICATIONS

This application claims priority of U.S. Provisional Application No. 60/926,095 filed on Apr. 26, 2007. The entire content of this prior application is incorporated herein by reference.

BACKGROUND OF THE INVENTION

1. Field of the Invention

The present invention relates generally to sprayers having removable spray nozzles and, in particular, to devices and methods for clearing obstructions from the spray nozzles of such sprayers.

2. Description of the Related Art

Modern sprayers typically have a plurality of spray nozzles arranged along a spray boom at spaced intervals. Many different types and sizes of sprayers are available for agricultural, industrial, commercial and private uses. Modern sprayers typically use quick-attach spray nozzles that can be quickly and easily removed from the boom for servicing and then reattached. The spray nozzles typically have replaceable spray tips and inline screen filters. Quick-attach spray nozzles allow sprayer operators to quickly and easily change spray tips, clean screen filters associated with the spray nozzles, and expose the spray tips for cleaning.

During the process of loading or filling a sprayer, dirt and other small debris often falls into the spray tank. Tank filters and other screen filters in the sprayer remove most of the debris, but some small amount often passes on through the sprayer to the spray nozzles. Mineral deposits in the water can also get into the spray tips and create obstructions. Spray lines also tend to collect traces of chemicals that form coatings within the sprayer parts over time. All of these types of particles can get caught in the spray tips of the spray nozzles during normal operation of the sprayer in the field. Also, if the sprayer operator turns too fast or too close to the end of the field, the spray boom can sometimes drag on the ground and block a spray tip with dirt and mud.

Most obstructions or plugs in the spray tips occur while the operator is out in the field spraying and away from a source of clean running water and/or compressed air that could be used to clean the spray tip. Conventional methods of clearing obstructions from spray nozzles in the field include using a razor or sharp knife to scratch out and break up the obstructions, followed by blowing on the spray tip or using a small piece of residue (e.g., the size of a toothpick) to push out the obstruction.

However, a razor or sharp knife will damage a spray tip if it is used too aggressively, which will result in a distorted spray pattern. When the operator blows on a spray tip to blow out the obstruction, the operator can be exposed to harmful chemicals. Using a small stick or piece of residue to remove the obstruction can also damage the delicate inner bore of the spray tip or break off in the spray tip and create an even bigger blockage.

Accordingly, there is a need in the industry for improved devices and methods for clearing obstructions from spray nozzles.

SUMMARY OF THE INVENTION

An object of the present invention is to provide a handheld device and method for clearing obstructions from spray nozzles without damaging the spray tips or creating an uneven or distorted spray pattern.

A further object of the present invention is to provide a handheld device and method for clearing obstructions from spray nozzles, which is easy and convenient to use; protects the operator from chemical exposure and contamination; is lightweight, portable, dependable, and inexpensive; and results in a substantial time savings for sprayer operators.

To accomplish these and other objects of the invention, a handheld device is provided for clearing obstructions from spray nozzles. The device includes a housing, a gas valve system contained within the housing, and a nozzle body attachment structure. A trigger associated with the gas valve system is operable to release a blast of compressed gas from a gas canister contained within the housing for discharge through the nozzle body attachment structure. A spray nozzle placed in contact with the nozzle body attachment structure receives the blast of compressed gas to clear obstructions from within the spray nozzle. The attachment structure interfaces with both the normal discharge side and the normal inlet side of the spray nozzle to allow compressed gas to be blown through the spray nozzle in both directions. A backup tool is provided to engage a backside of the spray nozzle to prevent the spray tip within the spray nozzle from blowing backwards out of the spray nozzle when the compressed gas is blown through the nozzle in a reverse direction of normal fluid flow. A backup tool cover prevents debris from entering the backup tool when it is not being used. The cover has a slender projection extending from one side thereof for removing screen filters associated with the spray nozzle.

According to a broad aspect of the present invention, a handheld device for clearing obstructions from spray nozzles is provided, comprising: a housing; a gas valve system contained within the housing for selectively releasing a blast of compressed gas through a discharge opening; and a nozzle body attachment structure arranged in fluid communication with the discharge opening of the gas valve system. The nozzle body attachment structure provides an interface between the handheld device and a spray nozzle to be cleaned.

According to another broad aspect of the present invention, a method of clearing obstructions from spray nozzles is provided, comprising: providing a handheld device having a housing, a gas valve system contained within the housing, and a nozzle body attachment structure arranged in fluid communication with a discharge opening of the gas valve system; placing a spray nozzle to be cleaned into contact with the nozzle body attachment structure; and selectively causing a blast of compressed gas to be released through the discharge opening of the gas valve system and the nozzle body attachment structure and into the spray nozzle to clear obstructions from the spray nozzle.

Numerous other objects of the present invention will be apparent to those skilled in this art from the following description wherein there is shown and described embodiments of the present invention, simply by way of illustration of some of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the present invention is made with reference to the accompanying drawings. In the drawings.

DETAILED DESCRIPTION OF THE INVENTION

Figure 1:
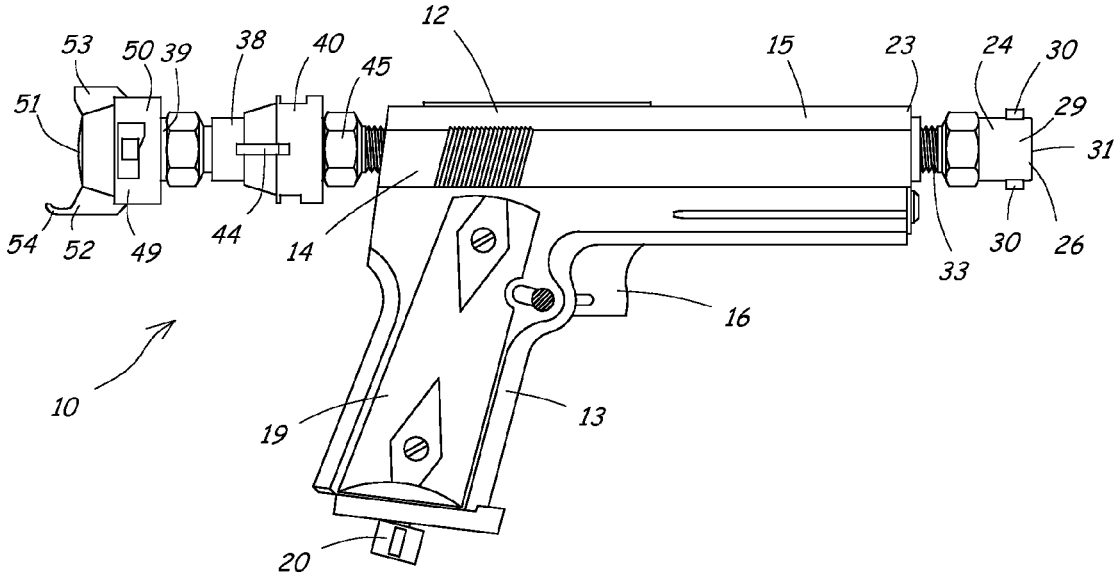
FIG. 1 is an elevation view of a handheld device for clearing obstructions from spray nozzles according to the present invention.
Figure 2:
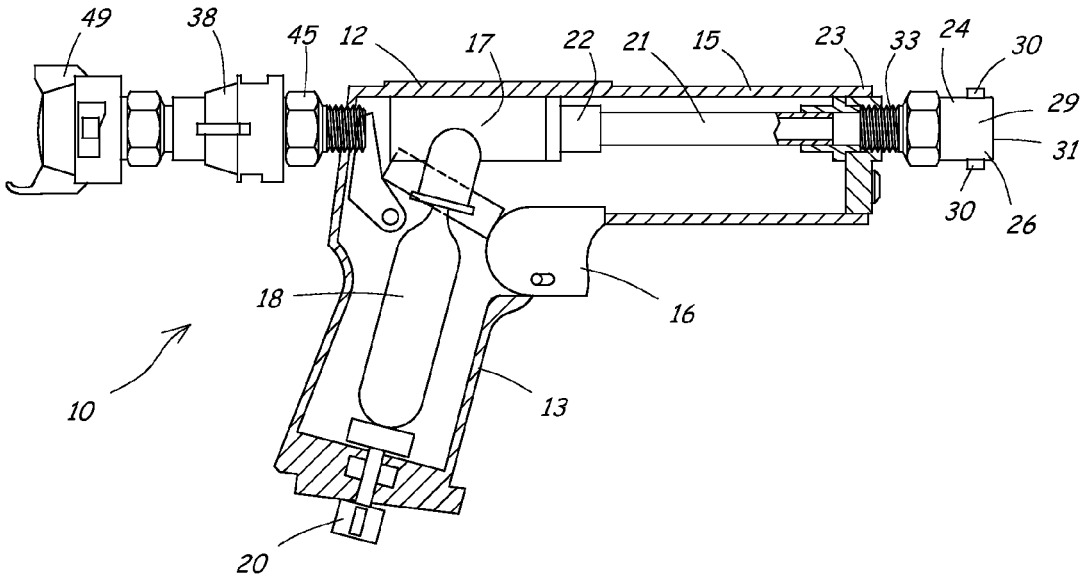
FIG. 2 is a cross sectional view of the handheld device shown in FIG. 1.
Figure 3:
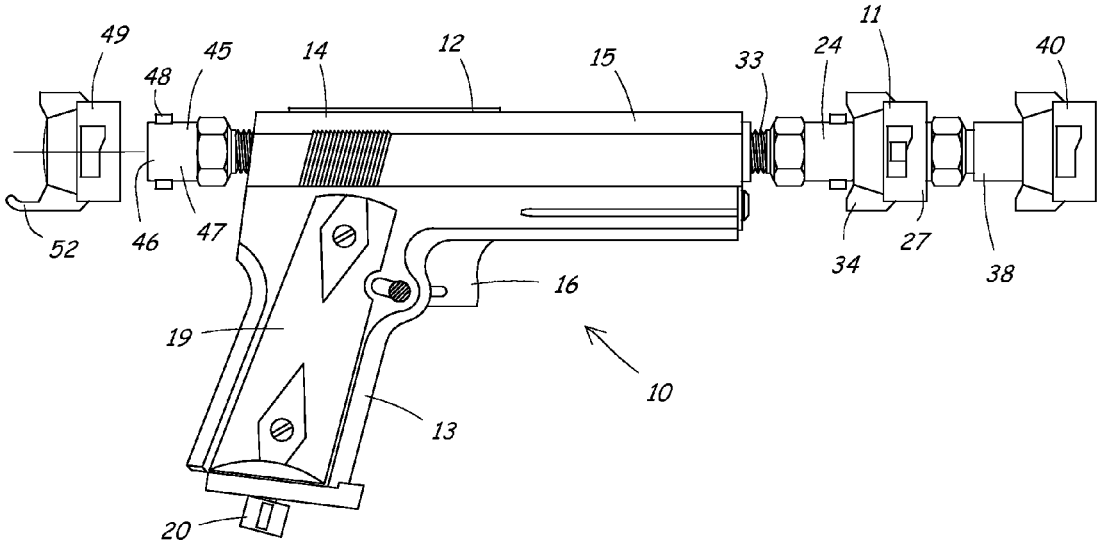
FIG. 3 is an elevation view of the handheld device with a spray nozzle coupled with a backup tool and positioned for receiving a blast of compressed gas through the spray nozzle in a reverse direction of normal fluid flow through the nozzle.
Figure 4:
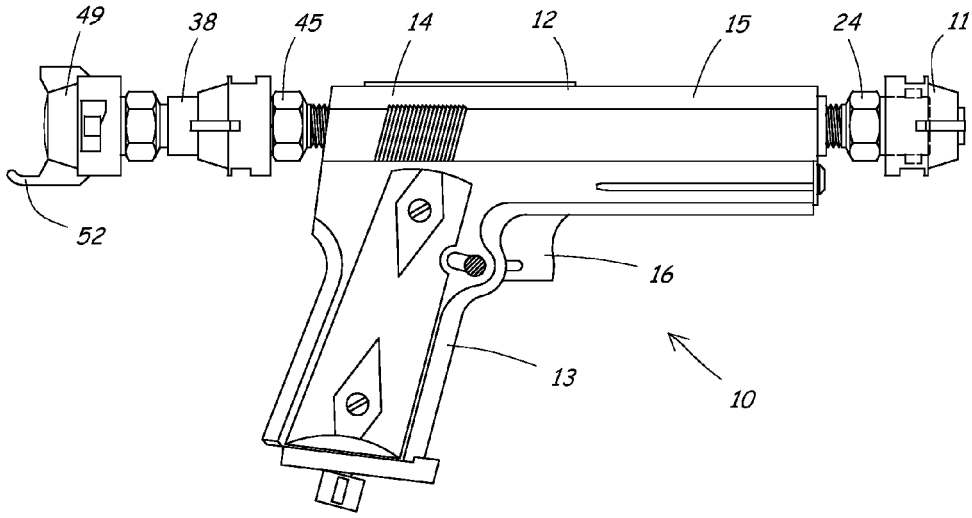
FIG. 4 is an elevation view of the handheld device with the spray nozzle positioned for receiving a blast of compressed gas in a normal direction of fluid flow through the nozzle.
Figure 5:
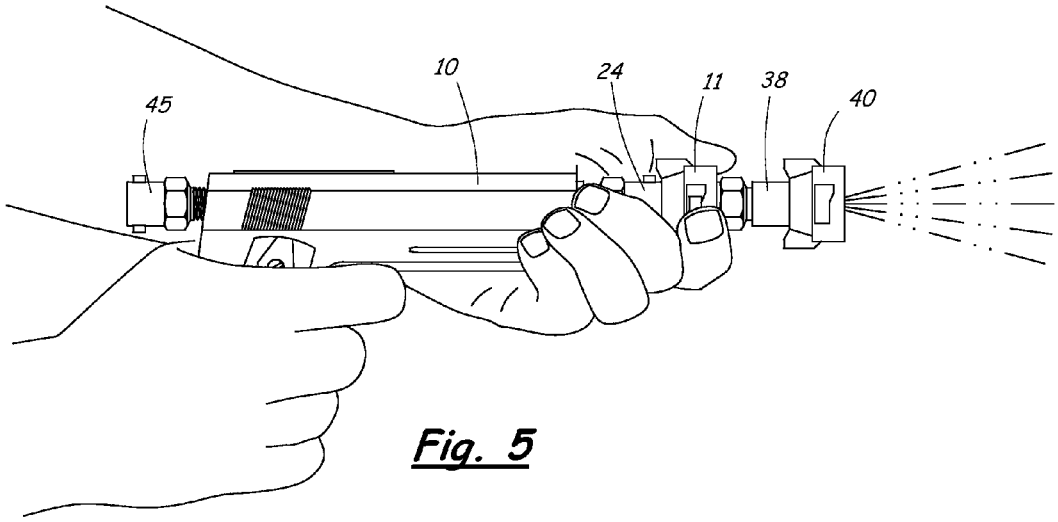
FIG. 5 shows the operation of the handheld device with the spray nozzle and backup tool positioned as shown in FIG. 3.
Figure 6:
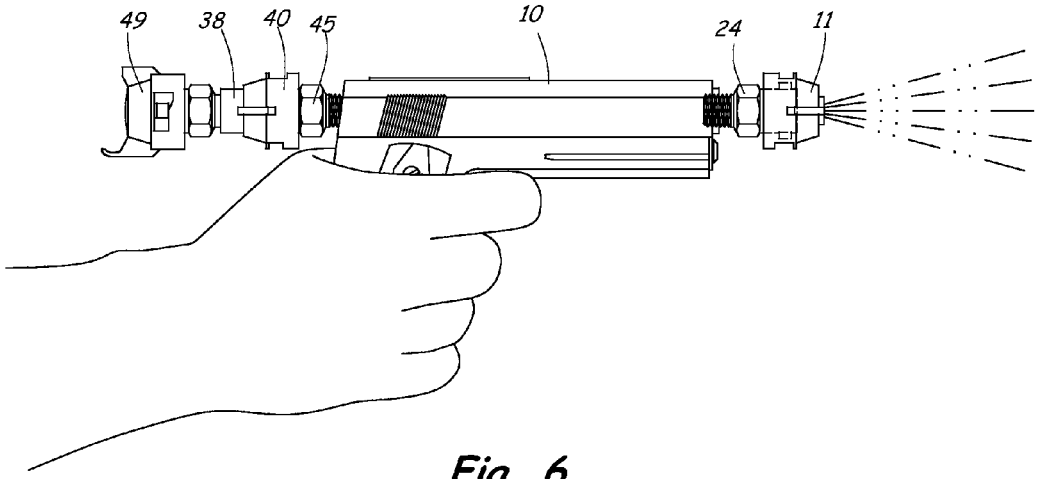
FIG. 6 shows the operation of the handheld device with the spray nozzle positioned as shown in FIG. 4.

A handheld device 10 and method for clearing obstructions from spray nozzles 11 according to the present invention will now be described in detail with reference to FIGS. 1 to 10 of the accompanying drawings.

The handheld device 10 is a portable, lightweight tool that can be carried with the sprayer operator for use in the field. The device 10 includes a housing 12 with a handle 13, a breech section 14, and a barrel section 15. The housing 12 can have the general shape of a handgun, as shown in FIGS. 1 to 9, and can be held in one hand in the same manner as a handgun. A trigger 16 is provided for operating the device 10 using the index finger.

A gas valve system 17 is contained within the housing 12. The gas valve system 17 is connected to a source of compressed gas, such as a conventional $CO_2$ cannister 18. Such $CO_2$ cannisters and gas valve systems are known in the prior art and widely used in connection with BB and pellet guns, paintball guns, and the like. A removable cover 19 is provided on the handle 13 of the housing 12 to remove and replace the gas cannister 18. A threaded clamp assembly 20 is provided at the bottom of the handle 13 to push the gas cannister 18 upward in the handle 13 to hold it in sealing engagement with the gas valve system 17 in a known manner.

The gas valve system 17 is constructed to selectively release a blast of compressed gas through a discharge opening each time the trigger 16 is squeezed. A barrel tube 21 carries the blast of compressed gas from the discharge opening 22 of the gas valve system 17 to the discharge end 23 of the barrel section 15 of the housing 12.

A nozzle body attachment structure 24 is arranged at the discharge end 23 of the barrel section 15. The barrel tube 21 is connected to the attachment structure 24 so that the attachment structure 24 is in fluid communication with the discharge opening 22 of the gas valve system 17. Thus, when the gas valve system 17 releases a blast of compressed gas, the gas is discharged through the inner bore 25 of the attachment structure 24. The attachment structure 24 provides an interface between the handheld device 10 and a spray nozzle 11 to be cleaned.

The attachment structure 24 comprises a male coupler structure 26 on its open discharge end, which is matable with a female coupler structure 27 on a backside 28 of the spray nozzle 11. The male coupler structure 26 comprises an outer cylindrical surface 29 and a pair of locking cogs 30 extending radially outward from the outer cylindrical surface 29. The locking cogs 30 are arranged to provide locking engagement with a pair of corresponding grooves in the female coupler structure 27 of the spray nozzle 11.

The attachment structure 24 also has an annular front structure 31 at the tip of its open discharge end. The annular front structure 31 can be placed tightly against a front side 32 of a spray nozzle 11 when the spray nozzle 11 is positioned to receive a blast of compressed gas in a reverse direction of normal fluid flow through the nozzle 11. Thus, the attachment structure 24 can be placed against either the backside 28 or the front side 32 of the spray nozzle 11 with a substantially fluid-tight interface.

The attachment structure 24 has a threaded portion 33 for mating with a corresponding threaded structure on the housing 12. The attachment structure 24 can thus be easily removed and replaced, if necessary, to accommodate spray nozzles 11 having different shapes, sizes and/or attachment configurations. In the illustrated embodiment, the attachment structure 24 is in the form of a conventional fitting that is commonly used to mount a spray nozzle on a sprayer.

Figure 7:
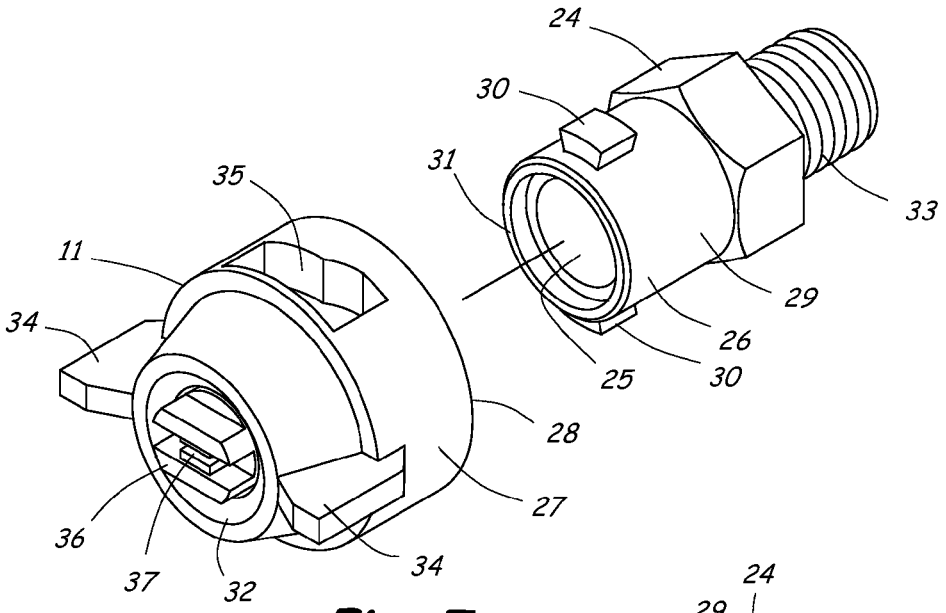
FIG. 7 is a perspective view of a conventional spray nozzle and a nozzle body attachment structure.
Figure 8:
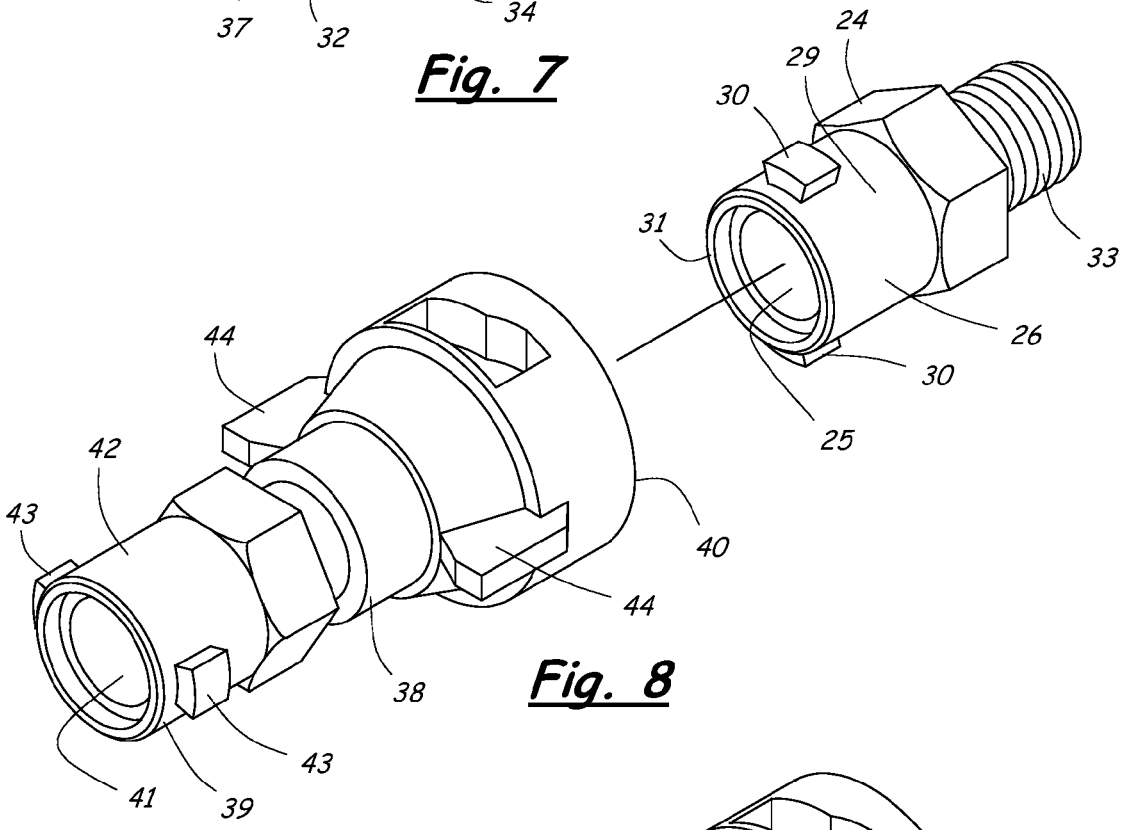
FIG. 8 is a perspective view of the backup tool and a backup tool holder according to the present invention.
Figure 9:
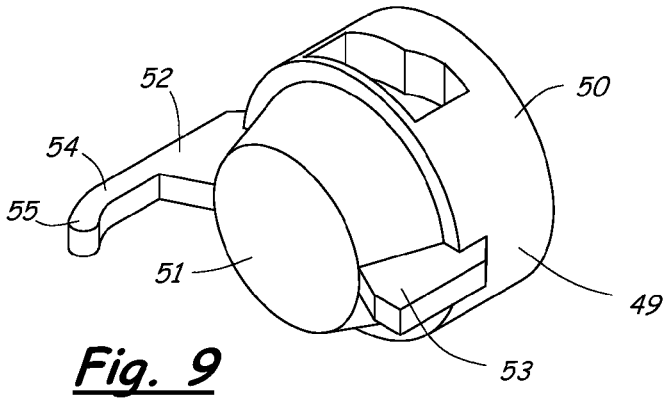
FIG. 9 is a perspective view of a backup tool cover according to the present invention.

A conventional spray nozzle 11 for a sprayer is shown in detail in FIG. 7, along with the nozzle body attachment structure 24. The spray nozzle 11 includes a front side 32, a backside 28, and a pair of wing portions 34 extending radially outwardly to facilitate rotating the spray nozzle 11 manually during coupling and uncoupling operations. A pair of grooves 35 are provided in the female coupler structure 27 of the spray nozzle 11 to provide locking engagement with the corresponding locking cogs 30 of the male coupler structure 26.

A removable spray tip 36 is contained within the spray nozzle 11. The spray tip 36 has an inner bore 37 with a precisely machined surface to provide a predetermined spray pattern from the spray nozzle 11. The spray tip 36 can be removed from the spray nozzle 11 by simply pushing it in a rearward direction. The spray tip 36 can be removed and replaced to change the desired spray pattern, fluid pressure, and/or flow rate of the sprayer to accommodate different spraying conditions, chemicals, and so forth.

The present invention uses a blast of compressed gas to clear obstructions from within the spray tip 36 of the spray nozzle 11. The obstructions are often created by particles that became lodged in the spray tip 36 as they try to pass through the spray tip 36 in a normal direction of fluid flow through the spray tip 36. Thus, it is usually most effective to clear the obstructions by blowing the compressed gas in a reverse direction through the inner bore 37 of the spray tip 36 relative to the normal fluid flow through the spray tip 36. However, the spray tip 36 will tend to blow out of the spray nozzle 11 when it is hit with a reverse flow of compressed gas.

Accordingly, a backup tool 38 is provided to couple with the backside 28 of the spray nozzle 11 to prevent the spray tip 36 from blowing backwards out of the spray nozzle 11. The backup tool 38 includes a male coupler structure 39 on a first end and a female coupler 40 on a second end opposite from the first end. An inner bore 41 extends through the backup tool 38 between the first and second ends 39, 40.

The male coupler structure 39 of the backup tool 38 is matable with the female coupler structure 27 on the backside 28 of the spray nozzle 11. The male coupler structure 39 has an outer cylindrical surface 42 and a pair of locking cogs 43 extending radially outward from the outer cylindrical surface 42. The locking cogs 43 are arranged to provide locking engagement with the corresponding grooves 35 in the mating female coupler structure 27 of the spray nozzle 11. A pair of wing portions 44 are provided on the backup tool 38 to facilitate manually handling the backup tool 38, and particularly to facilitate rotating the backup tool 38 when coupling and uncoupling with the spray nozzle 11.

A backup tool holder 45 is provided on a rear end of the housing 12. The backup tool holder 45 can have a structure similar to the attachment structure 24 on the discharge end of the barrel section 15. Specifically, the backup tool holder 45 can have a male coupler 46 with an outer cylindrical surface 47 and a pair of locking cogs 48 extending radially outward from the outer cylindrical surface 47. The locking cogs 48 are arranged to provide locking engagement with a pair of corresponding grooves in a mating female coupler structure, such as the female coupler 40 of the backup tool 38.

A backup tool cover 49 is provided for attaching to the backup tool 38 when the backup tool 38 is stored on the backup tool holder 45. The backup tool cover 49 has a female coupler structure 50 that mates with the male coupler structure 39 on the backup tool 38. A capped end 51 prevents debris from entering the first end 39 of the backup tool 38 when the backup tool cover 49 is installed on the backup tool 38.

The backup tool cover 49 has wing portions 52, 53 to facilitate rotating the backup tool cover 49 when coupling with the backup tool 38. A slender projection 54 with a hook-shaped end 55 extends forwardly from one of the wing portions 52. The slender projection 54 can be used as a tool to remove screen filters associated with the spray nozzles 11 being cleaned.

The handheld device 10 for clearing obstructions from spray nozzles 11 according to the present invention has been described above. A method of using the handheld device 10 will now be described.

A spray nozzle 11 containing an obstruction is removed from the sprayer by twisting the body of the spray nozzle 11 to uncouple the quick-attach coupling 27. The spray nozzle 11 with the spray tip 36 therein can then be placed into contact with the nozzle body attachment structure 24 for receiving a blast of compressed gas (e.g., $CO_2$ gas).

As described above, the spray nozzle 11 can be positioned for receiving a blast of compressed gas in a reverse direction of the normal fluid flow through the spray nozzle 11, or it can be positioned for receiving the blast of compressed gas in a normal direction of fluid flow. According to one preferred method, the spray nozzle 11 is first positioned for receiving one or more blasts of gas in a reverse direction of the normal fluid flow through the nozzle 11 to break up and expel most of the obstructions, and then another one or more blasts of gas in a normal fluid flow direction to finish clearing any remaining obstructions.

To position the spray nozzle 11 for receiving a blast of gas in a reverse direction, the spray nozzle 11 is first attached to the backup tool 38. This is accomplished by mating the male coupler structure 39 of the backup tool 38 with the female coupler structure 27 on the backside of the spray nozzle 11. As described above, the backup tool 38 prevents the spray tip 36 within the spray nozzle 11 from blowing backwards out of the spray nozzle 11.

The front side 32 of the spray nozzle 11 is then placed against the annular structure 31 at the discharge end of the nozzle body attachment structure 24. With the annular structure 31 pressed against the front side 32 of the spray nozzle 11 and held firmly, the user squeezes the finger-operated trigger 16 to cause the gas valve system 17 within the housing 12 to release a blast of compressed gas. The blast of compressed gas blows through the nozzle body attachment structure 24 and into the spray nozzle 11. The blast of compressed gas blows through the inner bore 37 of the spray tip 36 in a reverse direction of normal fluid flow, thereby dislodging and clearing obstructions from the spray nozzle 11. The user can squeeze the trigger 16 multiple times, if necessary, to break up and clear any particularly stubborn obstructions.

The spray nozzle 11 can then be removed from the backup tool 38, and the backup tool 38 can be coupled with the backup tool holder 45 at the rear of the housing 12 for storage. This is accomplished by attaching the female coupler 40 on the backup tool 38 to the corresponding male coupler 46 of the backup tool holder 45.

The spray nozzle 11 can then be connected directly to the attachment structure 24 for receiving a blast of gas in a normal fluid flow direction. This is accomplished by mating the male coupler structure 26 of the nozzle body attachment structure 24 with the corresponding female coupler structure 27 on the backside 28 of the spray nozzle 11. With the spray nozzle 11 coupled with the attachment structure 24, the user again squeezes the trigger 16 to cause the gas valve system 17 to release another blast of compressed gas. The blast of compressed gas this time blows through the inner bore 37 of the spray tip 36 in a normal direction of fluid flow to finish clearing any remaining obstructions from the spray nozzle 11.

When the backup tool 38 is in its stowed position on the backup tool holder 45, the backup tool cover 49 can be placed over the exposed end of the backup tool 38 to prevent debris from entering the backup tool 38. The backup tool cover 49 can also be coupled with the backup tool holder 45 directly for convenient storage when the backup tool 38 is being used.

The slender projection 54 on the backup tool cover 49 can be used to hook and remove screen filters associated with the spray nozzles 11. The screen filters can be removed and cleaned after removing the spray nozzles 11 from the sprayer. The handheld device 10 of the present invention can also be used to blow debris off of the screen filters to ensure adequate fluid flow through the screen filters.

Figure 10:
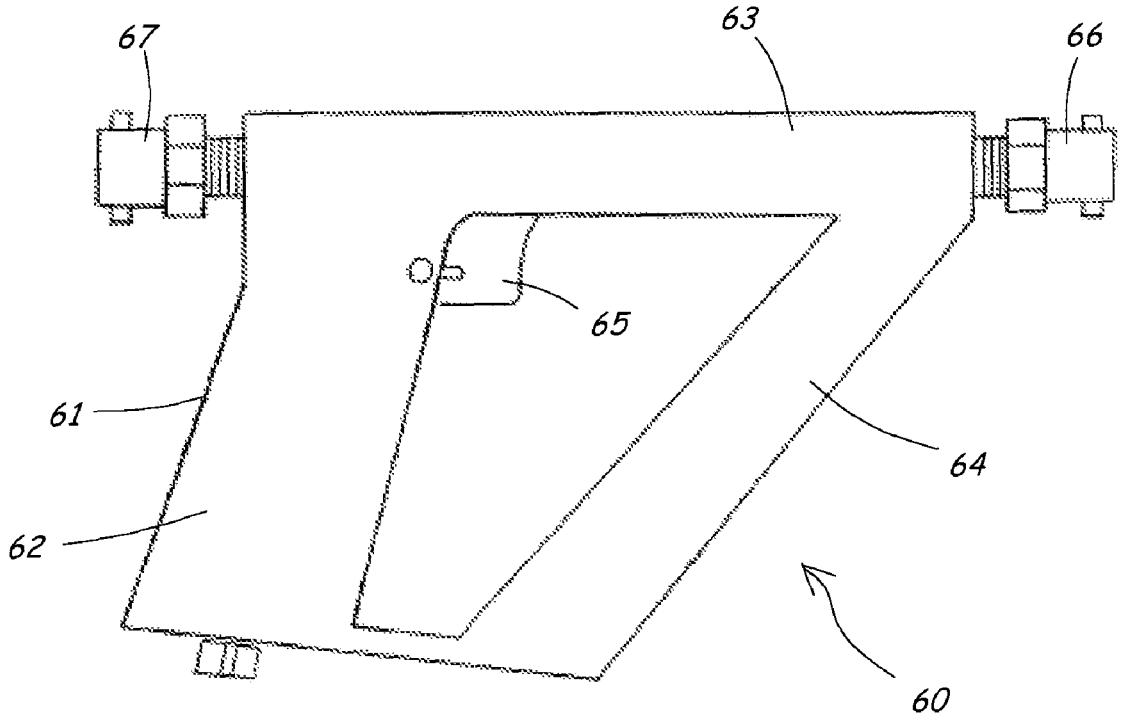
FIG. 10 is an elevation view of a handheld device according to another embodiment of the present invention.

A handheld device 60 according to another embodiment of the present invention is illustrated in FIG. 10. The device 60 includes a body 61 with a handle 62, a barrel section 63, and a front guard 64. The body 61 can be held in one hand in the same manner as the device 10 of the first embodiment described above. A trigger 65 is provided for operating the device 60 using the index finger. A gas valve system (not shown), attachment structure 66, and backup tool holder 67 are provided so that the device 60 can be operated in a manner similar to the device 10 in the first embodiment.

EXAMPLE

A working prototype of the present invention was made by modifying a Daisy Model 93 $CO_2$ BB pistol. The BB pistol was modified by removing several parts that were not necessary to the operation of the present invention. Specifically, the magazine, the parts that transfer BBs from the magazine to the barrel, and other nonessential parts associated with firing the BBs were removed.

A seal was then made to provide a fluid-tight connection between the rear end of the barrel tube and the gas valve system. Another seal was made to provide a fluid-tight connection between the discharge end of the barrel tube and a nozzle body attachment structure. The nozzle body attachment structure for the prototype was an existing sprayer fitting having a threaded portion at one end and a male coupler portion at the other end. The backup tool was made as shown in the drawings by modifying and assembling existing sprayer fittings suitable for the purpose.

Embodiments of the present invention has been described above. However, it should be understood that various changes to these embodiments have been contemplated by the Applicant and are intended to be covered by the present application. For example, the backup tool 38 can be attached to the housing 12 using a flexible cord or another suitable structure other than the backup tool holder 45 on the rear of the housing 12. For another example, the housing 12 of the device 10 can have a different shape or configuration besides that of a conventional handgun and still operate in substantially the same manner disclosed herein.

While the invention has been specifically described in connection with specific embodiments thereof, it is to be understood that this is by way of illustration and not of limitation, and the scope of the appended claims should be construed as broadly as the prior art will permit.

What is claimed is:

1. A handheld device for clearing obstructions from spray nozzles, comprising:

(a) a housing;

(b) a gas valve system contained within the housing, the gas valve system being connectible to a source of compressed gas and constructed to selectively release a blast of compressed gas through a discharge opening;

(c) a nozzle body attachment structure arranged in fluid communication with the discharge opening of the gas valve system, said nozzle body attachment structure providing an interface between the handheld device and a spray nozzle to be cleaned; and (d) a backup tool for holding a spray nozzle to be cleaned to keep a spray tip from blowing backwards out of the spray nozzle when a blast of compressed gas passes through the spray nozzle in a reverse direction of normal fluid flow, said backup tool being separate from said nozzle body attachment structure.

2. The handheld device according to claim 1, further comprising a trigger connected to the gas valve system for causing the gas valve system to selectively release a blast of compressed gas through the discharge opening.

3. The handheld device according to claim 1, wherein said backup tool comprises a male coupler structure on a first end matable with a female coupler structure on a backside of a spray nozzle.

4. The handheld device according to claim 1, wherein said nozzle body attachment structure comprises an annular surface at a front end thereof that can be placed tightly against a front side of a spray nozzle when the spray nozzle is positioned to receive a blast of compressed gas released by the gas valve system in a reverse direction of normal fluid flow through the nozzle.

5. The handheld device according to claim 1, wherein said housing comprises a handle, a breech section, and a barrel section.

6. The handheld device according to claim 5, wherein said nozzle body attachment structure is located at a discharge end of the barrel section of the housing.

7. The handheld device according to claim 1, wherein said nozzle body attachment structure has a threaded portion for attaching to a mating threaded structure on the housing.

8. The handheld device according to claim 3, wherein said male coupler structure further comprises an outer cylindrical surface and a pair of locking cogs extending radially outward from said outer cylindrical surface for locking engagement with a corresponding structure on a spray nozzle.

9. The handheld device according to claim 3, wherein said backup tool comprises a female coupler structure on a second end opposite from said first end, said female coupler structure being matable with a corresponding structure on the housing for storage when the backup tool is not being used.

10. The handheld device according to claim 9, further comprising a backup tool cover comprising a female coupler structure that mates with the male coupler structure on the backup tool and a capped end for preventing debris from entering the backup tool when the backup tool is not being used.

11. The handheld device according to claim 10, wherein said backup tool cover further comprises a slender projection extending from one side thereof for hooking and removing screens associated with spray nozzles.

12. A method of clearing obstructions from spray nozzles, comprising providing a handheld device having a housing, a gas valve system contained within the housing, and a nozzle body attachment structure arranged in fluid communication with a discharge opening of the gas valve system; placing a spray nozzle to be cleaned into contact with said nozzle body attachment structure; selectively causing a blast of compressed gas to be released through the discharge opening of the gas valve system and the nozzle body attachment structure and into the spray nozzle to clear obstructions from the spray nozzle; providing a backup tool having a male coupler structure on a first end; attaching the male coupler structure to a female coupler on a backside of the spray nozzle to prevent a spray tip within the spray nozzle from blowing backwards out of the spray nozzle; placing a front side of the spray nozzle against the nozzle body attachment structure; and causing the blast of compressed gas to pass through the spray nozzle in a reverse direction of normal fluid flow through the spray nozzle.

13. The method according to claim 12, wherein said gas valve system is attached to a source of compressed $CO_2$, gas, and said blast of compressed gas comprises $CO_2$, gas released from said source.

14. The method according to claim 12, wherein a finger-operated trigger is used to selectively cause a blast of compressed gas to be released by the gas valve system.

15. The method according to claim 12, further comprising providing a female coupler structure on a second end of the backup tool; and attaching the female coupler structure to a corresponding structure on the housing separate from the nozzle body attachment structure for storage of the backup tool when it is not being used.

16. The method according to claim 15, further comprising placing a backup tool cover over the male coupler structure on the first end of the backup tool to prevent debris from entering the backup tool when it is not being used.

17. The method according to claim 16, further comprising providing said backup tool cover with a slender projection extending from one side thereof; and using said slender projection to hook and remove a screen filter associated with the spray nozzle.

18. The method according to claim 12, further comprising attaching said spray nozzle to said nozzle body attachment structure by mating a male coupler of the nozzle body attachment structure with a female coupler on a backside of the spray nozzle; and causing the blast of compressed gas to pass through the spray nozzle in a normal direction of fluid flow through the spray nozzle.

19. An assembly for alternative rearward and forward clearing of an obstruction from a spray tip, the spray tip having a forward output end, a rearward intake end, and having an inner bore extending therebetween, the spray tip being rearwardly slidably received and forwardly captured within a nozzle, the nozzle having open forward and rearward ends, the spray tip's forward output end being exposed at the nozzle's open forward end and the spray tip's rearward intake end being exposed at the nozzle's open rearward end, the assembly comprising:

(a) a female coupler fixedly attached to and extending rearwardly from the nozzle;

(b) a male coupler having an inner bore, an intake end, and an output end, the male coupler being matable with the female coupler, the male coupler, upon mating with the female coupler, further rearwardly capturing the spray tip within the nozzle and communicating its inner bore with the spray tip's inner bore;

(c) another male coupler having an inner bore, an intake end and an output end, said other male coupler being alternatively matable with the female coupler, said other male coupler, upon said alternative mating with the nozzle's female coupler, communicating its inner bore with the spray tip's inner bore; and (d) compressed gas discharging means connected operatively to said other male coupler's intake end, the compressed gas discharging means being actuatable to, upon mating of the male coupler with the female coupler, and upon placement of the nozzle's open forward end in communication with said other male coupler's output end, rearwardly clear the obstruction from the spray tip, and the gas discharging means being further actuatable to, upon the alternative mating of the female coupler with said other male coupler, forwardly clear the obstruction from the spray tip.

* * * * *